US005825264A

United States Patent [19]

Yamazaki et al.

[11] Patent Number: 5,825,264

[45] Date of Patent: Oct. 20, 1998

[54] STRIPLINE LAMINATE DIELECTRIC FILTER WITH INPUT/OUTPUT PATTERNS OVERLAPPING RESONATOR CONDUCTORS

[75] Inventors: Kazuhisa Yamazaki; Nobuaki Nakamura; Yuji Matsushita, all of Hamamatsu; Hisao Sato; Tomohiko Ban, both of Kosai, all of Japan

[73] Assignee: FDK Corporation, Tokyo, Japan

[21] Appl. No.: 799,087

[22] Filed: Feb. 12, 1997

Related U.S. Application Data

[63] Continuation of Ser. No. 428,991, Apr. 26, 1995, abandoned.

[30] Foreign Application Priority Data

May 18, 1994 [JP] Japan ..... 6-127119
Jun. 8, 1994 [JP] Japan ..... 6-148756

[51] Int. Cl.[6] ..... H01P 1/203

[52] U.S. Cl. ..... 333/204; 333/246

[58] Field of Search ..... 333/203, 204, 333/205, 214, 235, 246

[56] References Cited

U.S. PATENT DOCUMENTS

| | | | |
|---|---|---|---|
| Re. 31,470 | 12/1983 | Bedard et al. | 333/204 |
| 5,105,173 | 4/1992 | Itou | 333/204 |
| 5,344,695 | 9/1994 | Hirai et al. | 333/205 X |
| 5,374,909 | 12/1994 | Hirai et al. | 333/204 |
| 5,412,358 | 5/1995 | Hirai et al. | 333/204 |
| 5,479,141 | 12/1995 | Ishizaki et al. | 333/204 |

FOREIGN PATENT DOCUMENTS

| | | | |
|---|---|---|---|
| 57-204602 | 12/1982 | Japan . | |
| 5110305 | 4/1993 | Japan | 333/204 |
| 5-191105 | 7/1993 | Japan . | |
| 5259704 | 10/1993 | Japan | 333/204 |

*Primary Examiner*—Robert J. Pascal
*Assistant Examiner*—Justin P. Bettendorf
*Attorney, Agent, or Firm*—Evenson, McKeown, Edwards & Lenahan, PLLC

[57] ABSTRACT

A dielectric filter includes a laminate substrate formed by laminating and bonding a plurality of dielectric sheets, belt-like resonance electrodes formed on predetermined bond surfaces of the dielectric sheets, input/output electrodes formed at predetermined positions of an outer periphery of the laminate substrate and connected to the belt-like resonance electrodes, and earth electrodes formed on the outer periphery of the laminate substrate under a non-connection state with the input/output electrodes. The end portions of the belt-like resonance electrodes extend to both side surfaces of the laminate substrate. One end of each belt-like resonance electrode is connected to the earth electrode formed on one of the side surfaces of the laminate substrate and serves as a short-circuit terminal, and the other end of the belt-like electrode is exposed on an ungrounded portion on the opposite side surface and serves as an open terminal.

7 Claims, 8 Drawing Sheets

STRIPLINE LAMINATE DIELECTRIC FILTER WITH INPUT/OUTPUT PATTERNS OVERLAPPING RESONATOR CONDUCTORS

This is a continuation of application Ser. No. 08/428,991, filed Apr. 26, 1995, abandoned.

BACKGROUND OF THE INVENTION

This invention relates to a laminate dielectric filter utilized as a circuit device of mobile communication apparatuses using a UHF band and a microwave band (e.g. portable telephone, cordless telephone, wireless LAN, GPS, etc.) and a method of producing such a filter. The present invention relates also to an improvement in a strip line type laminate dielectric filter produced by interposing resonator internal conductors having a predetermined shape between a plurality of dielectric sheets disposed in lamination.

In a strip line type laminate dielectric filter according to the prior art, an integral laminate substrate is constituted by laminating and bonding a plurality of dielectric sheets, and belt-like resonance electrodes, the length of which is set to a ¼ wavelength, are formed in parallel on predetermined bond surfaces of a plurality of dielectric sheets. Earth electrodes are formed on both sides of the laminate substrate. One end of each belt-like resonance electrode is connected to the earth electrode in various forms, and the other end of each belt-like resonance electrode serves as an open terminal. Input/output electrodes having various shapes are disposed in association with predetermined ones of the belt-like resonance electrodes at predetermined positions.

An example of this filter construction is described in U.S. Pat. No. 4,266,206.

According to this construction, first and second dielectric blocks constitute a laminate substrate, and each of the blocks is produced by laminating a large number of dielectric sheets (green sheets). Three belt-like resonance electrodes are formed in parallel with one another on the upper surface of the first dielectric block disposed on the lower side. An earth electrode is formed substantially throughout the entire surface of the lower surface of the first dielectric block, the upper surface of the second dielectric block and a predetermined side surface.

A belt-like pattern extending in a direction orthogonal to the belt-like resonance electrode is formed on one end (short-circuit terminal) of each belt-like resonance electrode at which it is connected to the earth electrode, and electric connection with the earth electrode on the side surface is established through this belt-like pattern. On the other hand, the other end (open terminal) of each belt-like electrode is a predetermined distance away from the opposite belt-like pattern.

The laminate dielectric filter having the construction described above is produced in the following way. To produce a large number of filters at one time, patterns having a predetermined shape are printed with silver paste on a green sheet having a predetermined size, and a predetermined number of unprinted green sheets are then laminated and are cut at predetermined positions to separate individual filter blanks. A conductor pattern is printed at a predetermined portion of the side surface of each filter blank so separated.

Incidentally, the length of each belt-like resonance electrode affects frequency characteristics. In the construction of the U.S. Patent described above, even when any printing error or cutting error exists, the cutting position exists at the portion of the belt-like pattern, so that the distance of the belt-like resonance electrode is the length from the boundary with the belt-like pattern to the distal end and is thus kept constant.

However, the laminate dielectric filter having the conventional construction described above involves various problems. First, since the size of communication apparatuses that use the filter has become smaller and smaller, the size of the laminate dielectric filter, too, must be reduced, but the length of the belt-like resonance electrode must be the ¼ wavelength of the resonance frequency as described above. Besides the length corresponding to at least this ¼ wavelength, the width of the two belt-like patterns and the length of a region defined between the belt-like pattern and the open end of the belt-like resonance electrode are necessary, and there is a limit to miniaturization.

The bonding strength of the green sheets adjacent to each other in the vertical direction while interposing the belt-like resonance electrode between them decreases because the belt-like pattern exists in addition to the belt-like resonance electrode and because the direct bond area of the green sheets thus becomes small. As a result, delamination is likely to occur at the bond portion.

Generally, the electrode portion is formed by screen printing the silver paste or the like. Because the silver paste is expensive, however, the amount of use is preferably as small as possible. However, according to the conventional construction, the formation of the belt-like pattern is essentially necessary from the requirements of production processes in order to eliminate fluctuation of the frequency characteristics of the filter resulting from printing error, etc., and the existence of this belt-like pattern impedes the reduction of the cost of production. Further, because the electrode portion shrinks because the solvent evaporates after printing, wrinkles are likely to develop in the electrode formation portion of the green sheet. From this aspect, too, there is the requirement for reducing the electrode area, but because the belt-like resonance electrode and the belt-like pattern must be disposed by all means as described above, there is also a limit to the prevention of the occurrence of wrinkles.

Further, to produce the laminate dielectric filter described above, the predetermined patterns (patterns of the belt-like resonance electrode and the belt-like pattern) are formed on the predetermined green sheet by screen printing, etc., but a mask for printing has to be corresponding to the frequency characteristics of the filter to be produced. Accordingly, it is necessary to prepare in advance a plurality of masks and to select and use a desired mask from them. Thus maintenance and management of the masks are troublesome. If any design change becomes necessary (the length of the ¼ wavelength changes with the frequency change), different masks must be produced once again to cope with such a change.

Besides the prior art described above, Japanese Patent Laid-Open No. 57-204602/1982 discloses a strip line type dielectric filter. In the dielectric filter of this prior art reference, a metallic plate is interposed between a pair of rectangular flat sheet-like dielectric blocks. This metallic plate comprises resonator internal conductors which resonate at the ¼ wavelength or at a multiple of the ¼ wavelength, and an earth conductor connected in common to one side of the resonator internal conductors. The metallic plate is formed integrally with an input/output conductor having a substantially L-shaped flat surface and spaced apart by a predetermined distance from, and parallel to, the resonator internal conductor.

In the dielectric filter of Japanese Patent Laid-Open No. 57-204602/1982 described above, the length of at least ¼ wavelength is necessary as the length of the resonator internal conductor constituting the metallic plate. Accordingly, its outer dimension in the direction of length is limited, and the size of the filter cannot be any smaller. To solve this problem, Japanese Patent Laid-Open No. 5-191105/1993 discloses a laminate dielectric filter.

According to the construction of Japanese Patent Laid-Open No. 5-191105/1993, three belt-like resonator internal conductors are disposed by printing between dielectric sheets at an intermediate position in a vertical direction of a laminate substrate formed by laminating and disposing a plurality of dielectric sheets. An external conductor (earth electrode) is formed on the outer peripheral surface of the laminate substrate and serves as an earth surface, and one end of each resonator internal conductor is connected to the earth electrode and serves as a short-circuit terminal. A load capacitance pattern is formed on a dielectric sheet different from the dielectric sheet on which a resonator internal conductor is formed, in such a manner as to partially overlap the open end of the resonator internal conductor, and one end of this load capacitance pattern is connected to the earth electrode. In this case, the load capacitance pattern becomes an earth pattern inserted and disposed inside the laminate substrate.

According to the construction described above, a load capacitance occurs between the resonator internal conductor and the load capacitance pattern. Then, the reference frequency becomes lower, and thus the length of the resonator internal conductor required for resonance at a desired frequency can be reduced. In other words, a desired dielectric filter can be constituted by using a resonator internal conductor having a length smaller than the ¼ wavelength. Accordingly, the length of the laminate substrate in the axial direction of the resonator internal conductor, that is, the laminate dielectric filter, can be shorter than ¼ wavelength, and the size of the filter can be reduced. Incidentally, an input/output terminal having a substantially L-shaped flat surface is formed on the same place as the formation surface of the resonator internal conductor and is so arranged as to establish magnetic field coupling with the resonator internal conductors of the initial stage (the resonator internal conductors on both sides).

Although the conventional laminate dielectric filter described above can accomplish reduction of the size in the axial direction of the resonator internal conductor, this filter still involves the following problems. In other words, in the dielectric filters of both of Japanese Patent Laid-Open Nos. 57-204602/1982 and 5-191105/1993, the L-shaped input/output electrode and the input/output terminal pattern must be disposed on the same plane as the resonator internal conductor and outside both ends with a predetermined distance, and the width perpendicular to the resonator internal conductor cannot be reduced.

Moreover, in the type having the load capacitance pattern (Japanese Patent Laid-Open No. 5-191105/1993), the electric field concentrates on the load capacitance pattern portion. For this reason, another problem develops in that initial stage coupling between the input/output terminal pattern and the resonator internal conductor is weak, and the bandwidth of the filter is limited.

SUMMARY OF THE INVENTION

The present invention is completed in view of the background described above, and it is a primary object of the present invention to provide a laminate dielectric filter, free from the problems described above, which does not require the disposition of the belt-like pattern extending across the belt-like resonance electrode even in a laminate dielectric filter of the type in which electrodes having a predetermined pattern are formed by printing on the dielectric sheets (green sheets).

Another object of the prevent invention is to provide a laminate dielectric filter which can set the length of the belt-like resonance electrodes to a predetermined value, can therefore reduce the size of the product as a whole, can minimize the electrode area used, can improve the bonding strength between the dielectric sheets, can prevent the occurrence of wrinkles at the electrode portions (the sheet on which the electrodes are formed) and can reduce the cost of production, and also a production method of such a filter.

In the aspect of one production method, the present invention provides a production method of a laminate dielectric filter which, in addition to various objects described above, can accomplish the common use of masks for producing filters having various frequency characteristics, can easily cope with a design change, if such a change becomes necessary, and can fundamentally utilize existing setups without increasing the number of steps in the conventional production process.

Another object of the present invention is to provide an improved laminate dielectric filter which can contribute to the reduction of the size of a product as a whole by reducing the size of an input/output terminal portion, can easily establish matching by increasing the initial stage coupling between the input/output terminal pattern and resonator internal conductors, can secure sufficient initial stage coupling even when a load capacitance pattern exists, can reduce the limitation to the bandwidth of the filter and can increase the bonding strength to prevent peel on the bond surface.

A further object of the present invention is to provide a laminate dielectric filter which can easily change the initial stage coupling without changing the appearance of a product, can stabilize filter characteristics, and can be easily produced and mounted.

A dielectric filter according to the present invention comprises a laminate substrate formed by laminating and bonding a plurality of dielectric sheets, belt-like resonance electrodes formed on predetermined bond surfaces of the dielectric sheets, input/output electrodes formed at predetermined positions of the outer periphery of the laminate substrate and connected to the belt-like resonance electrodes and earth electrodes formed on the outer periphery of the laminate substrate under a non-connection stage with the input/output electrodes, wherein one end of each belt-like resonance electrodes is connected to the earth electrode formed on the side surface and serves as a short-circuit terminal, and the other end is exposed on the ungrounded portion of the other side surface and is used as the open terminal.

As the belt-like resonance electrode, a plurality of electrodes may be disposed in parallel. In this case, the open terminals and the short-circuit terminals of these belt-like resonance electrodes may be disposed alternately on one of the side surfaces of the laminate substrate. Further, the open terminals of a plurality of belt-like resonance electrode may be disposed on one of the side surfaces of the laminate substrate and the short-circuit terminals, on the other side surface. In this case, a coupling adjustment electrode is formed at a predetermined position between the adjacent belt-like resonance electrodes on one of the side surfaces on which the open ends are formed.

In the method of producing the laminate dielectric filter described above, the dielectric sheets are laminated and the belt-like resonance electrodes are formed on the surface of the predetermined dielectric sheets and are then bonded by thermocompression. Then, the dielectric sheets are cut at a predetermined position in a direction extending across the resonance electrode pattern, and are then cut at a predetermined position parallel to the resonance electrode pattern. In this way, the laminate substrate having a predetermined size is formed, and the predetermined pattern is formed on the side surface of this laminate substrate. Thereafter, predetermined treatment such as baking is carried out.

Both ends of the belt-like resonance electrode reach both side surfaces of the laminate substrate, and the length of the laminate substrate is equal to the length of the beltlike resonance electrode. Accordingly, when the length of the laminate substrate corresponds to the ¼ wavelength of a predetermined frequency, it becomes the length of the resonance electrode. In this way, the belt-like pattern becomes unnecessary and the size of the filter can be reduced. When the dielectric sheet is cut at a predetermined length, which is a little greater than the length of the ¼ wavelength in consideration of shrinkage due to sintering, when cutting out the laminate substrate, a filter having accurate frequency characteristics can be produced.

The pattern formed on the dielectric sheet may be an elongated belt-like pattern irrespective of the frequency characteristics of the filter to be produced, and the masks can be thus used in common. In other words, even when the required frequency characteristics are changed, it is only necessary to change the cutting length of the dielectric sheet in the extending direction of the belt-like pattern.

The dielectric filter according to another embodiment of the present invention comprises a laminate substrate formed by laminating a plurality of dielectric sheets, resonator internal conductors formed on predetermined bond surfaces of the dielectric sheets, earth patterns formed on the outer periphery of the laminate substrate, input/output electrodes formed on the outer periphery of the laminate substrate under a non-contact state with the earth pattern, and input/output patterns formed on the bond surface, different from the bond surface on which the resonator internal conductors are formed, in such a manner as to overlap the predetermined resonator internal conductors and connected to the input/output electrodes.

In the construction described above, it is preferred to prepare two input/output terminal patterns which overlap one resonator internal conductor, and to arrange the two input/output patterns opposed to each other while interposing the resonator internal conductor between them.

The laminate dielectric filter of the present invention preferably includes a load capacitance pattern which is disposed inside the laminate substrate in such a manner as to overlap the open end portion and to be spaced apart by a predetermined distance therefrom in the direction of thickness.

On the other hand, the shape of the input/output electrode may be such that it vertically penetrates through the side surface of the laminate substrate and partly bridges the top and bottom surfaces continuing the side surface. Alternatively, the input/output electrode may be so shaped as to bridge the lower portion of the laminate substrate and a part of the bottom surface continuing this lower portion.

Furthermore, it is possible to employ the structure wherein the input/output electrodes are formed at the predetermined position of the bottom surface of the laminate substrate and connection between the input/output electrodes and the input/output terminal pattern is made through a conductive passage disposed inside the laminate substrate.

The input/output terminal pattern is so disposed as to overlap the resonator internal conductor of the initial stage with a predetermined distance in the direction of thickness. Then, the input/output terminal pattern and the resonator internal conductor establish capacitive coupling. Since the input/output terminal pattern is connected to the input/output terminal having the predetermined shape and disposed on the surface of the laminate substrate, it couples with the input/output terminal through this input/output terminal pattern.

This coupling becomes stronger when the overlapping area is greater and when the distance between the input/output terminal pattern and the resonator internal conductor is smaller. Accordingly, desired initial stage coupling can be obtained even when the size of the input/output terminal pattern is reduced. Since the input/output terminal pattern and the resonator internal conductor are so disposed as to overlap one another in the vertical direction, a large area becomes unnecessary outside the resonator internal conductor in addition to the reduction of the size of the input/output terminal pattern. Accordingly, the outer diameter of the product can be reduced.

BEST MODE FOR CARRYING OUT THE INVENTION

Hereinafter, a dielectric filter and a production method thereof according to some preferred embodiments of the present invention will be explained with reference to the drawings.

Figure 1:
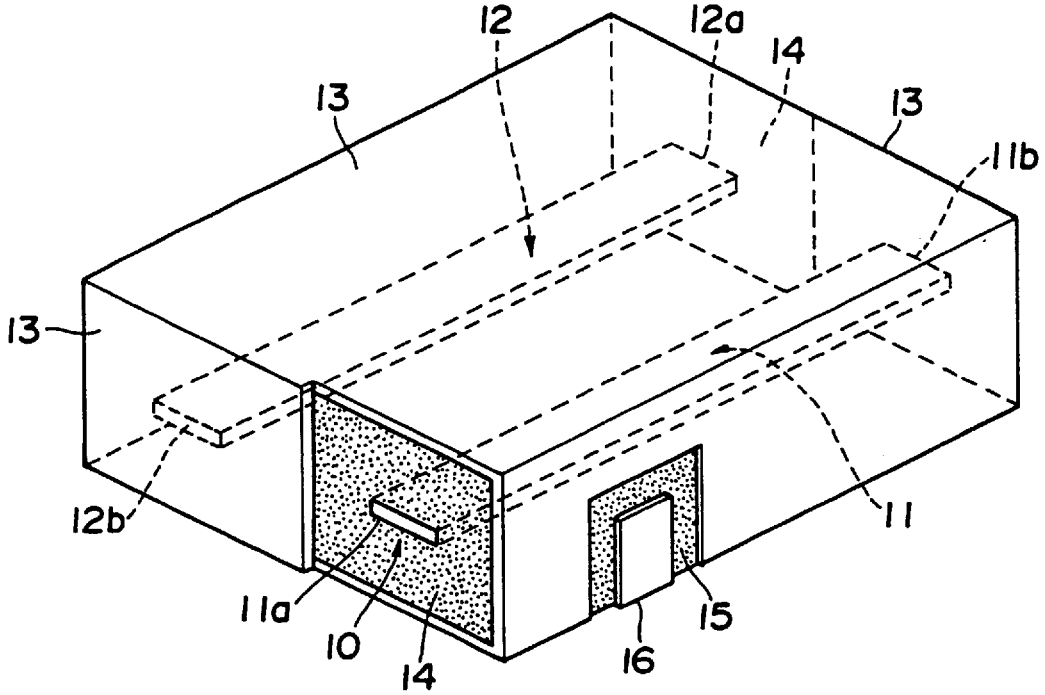
FIG. 1 is a perspective view of a laminate dielectric filter according to a first embodiment of the present invention.

FIG. 1 shows a dielectric filter adapted to a two-stage interdigital filter. First, a flat and rectangular laminate substrate 10 is constituted by laminating and bonding a plurality of dielectric sheets (green sheets). Two belt-like resonance electrodes 11 and 12 are formed and disposed in parallel with each other by screen printing using a silver paste on a predetermined green sheet at the central position in the direction of the height of the laminate substrate 10. A surface earth electrode 13 is formed throughout the entire surface of both upper and lower surfaces of the laminate substrate 10. Incidentally, a region in which the earth electrode is not formed or partially formed on the lower surface for the purpose of surface mounting may be present.

In the present invention, both ends of each belt-like resonance electrode 11, 12 are so formed as to reach the side surfaces of the laminate substrate 10. The length of each belt-like resonance electrode 11, 12 is equal to a ¼ wavelength of a resonance frequency and is smaller than the lengths of conventional devices.

An earth electrode 13 is formed in only the half of the side surface of the laminate substrate 10 to which each belt-like resonance electrode 11, 12 is extended, and the remaining half is used as an ungrounded portions 14 so as to expose the laminate substrate 10. The ungrounded portions 14 are mutually opposite between both side surfaces. According to this arrangement, the respective ends 11*a*, 12*a* of belt-like resonance electrode 11, 12 are exposed at this ungrounded portion 14 and functions as an open end portion. The other ends 11*b*, 12*b* of each belt-like resonance electrode 11, 12 are connected to the earth electrode formed on this side surface and functions as a short-circuit end portion.

In this embodiment, an input/output electrode 16 isolated from the earth pattern is formed at a predetermined position of the side surface parallel to each belt-like resonance electrode 11, 12 of the laminate substrate 10 in the vicinity of the open end portion through a U-shaped ungrounded portion 15.

As described above, there is no belt-like pattern extending across the short-circuit end of each belt-like resonance electrode unlike the construction of the prior art, and only the belt-like resonance electrodes 11, 12 exist inside the laminate substrate 10. Accordingly, the electrode area may be smaller, the bonding strength of the dielectric sheet can be improved, the cost of production can be reduced due to the reduction of the amount of the silver paste used, and the occurrence of wrinkles can be prevented.

Figure 2:
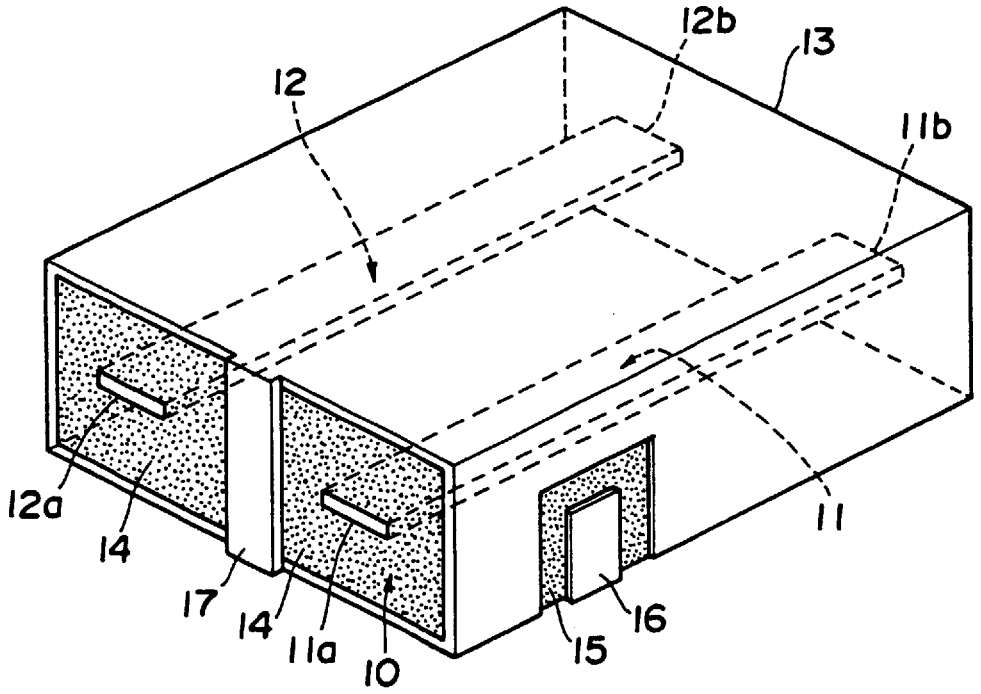
FIG. 2 is a perspective view of a laminate dielectric filter according to a second embodiment.

FIG. 2 shows the laminate dielectric filter according to the second embodiment of the present invention. The first embodiment described above represents the application of the present invention to the two-stage interdigital filter, but this embodiment of FIG. 2 represents the application to a two-stage combine filter.

In other words, two belt-like resonance electrodes 11, 12 are disposed in parallel with each other at the central position in the direction of the height of the laminate substrate 10 and moreover, both ends of the belt-like resonance electrodes are extended to the side surfaces of the laminate substrate 10. The length of each belt-like resonance electrode 11, 12 is equal to the ¼ wavelength of the resonance frequency in the same way as in the first embodiment. Further, the surface electrode 13 is formed through the substantially entire surface of each of the upper and lower surfaces of the laminate substrate 10 and the input/output electrode 16 isolated from the earth pattern is formed at predetermined position of the side surface parallel to the belt-like resonance electrodes 11, 12 in the vicinity of the open end portion through the U-shaped ungrounded portion, in the same way as in the first embodiment.

Because the filter in this second embodiment is of the combine type, the ungrounded portions 14 formed on the side surface of the laminate substrate 10, to which one of the end portions 11*a*, 12*a* of each belt-like resonance electrode 11, 12 is extended, is formed on the same surface, and the other end 11*b*, 12*b* as the short-circuit end portion is formed on the same surface on the opposite side.

In this embodiment, a coupling adjustment electrode 17 is so formed at the center of the open end (belt-like resonance electrode) as to extend in the vertical direction. This coupling adjustment electrode 17 is constituted of one belt-like member extending in the vertical direction in such a manner as to connect the earth electrodes 13 formed on the upper and lower surfaces of the laminate substrate 10, respectively. The coupling adjustment electrode 17 adjusts the coupling state between the belt-like resonance electrodes 11 and 12. In other words, since the coupling state can be changed by cutting the side edge of the coupling adjustment electrode 17, fine adjustment can be made after production. The rest of construction and the function and effects are the same as those of the first embodiment; hence, a further explanation will not be necessary.

Figure 3A:
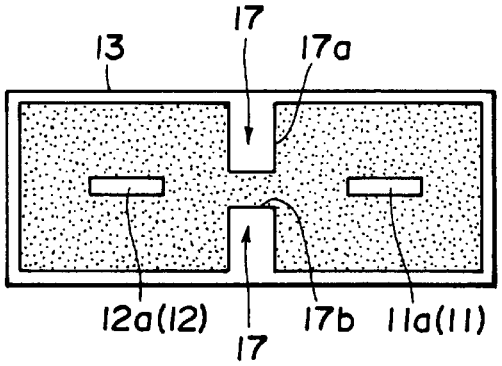
FIG. 3A and 3B are side views eaching showing still another modified example of the second embodiment of the invention.

The shape of the coupling adjustment electrode 17 is not particularly limited to one belt-like shape extending in the vertical direction, as used in this embodiment. For example, the coupling adjustment electrode 17 may comprise two protuberances cut at the center in the direction of the height as shown in FIG. 3A. In this case, the coupling condition can be adjusted by cutting the side edge 17*a* or the distal end 17*b*.

Figure 3B:
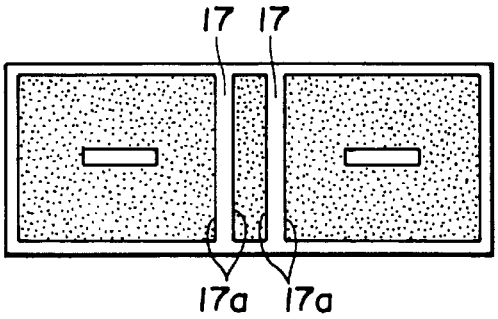

The coupling adjustment electrode 17 may be shaped to have a plurality of (two, in the example shown) belts extending in the vertical direction so as to connect the earth electrodes 13 formed on the upper and lower surfaces of the laminate substrate 10 as shown in FIG. 3B. In this case, too, the coupling state can be adjusted by cutting an arbitrary side edge 17 by a predetermined depth. These examples shown in the drawing are not particularly limitative and various other patterns may be used, as well.

Figure 4:
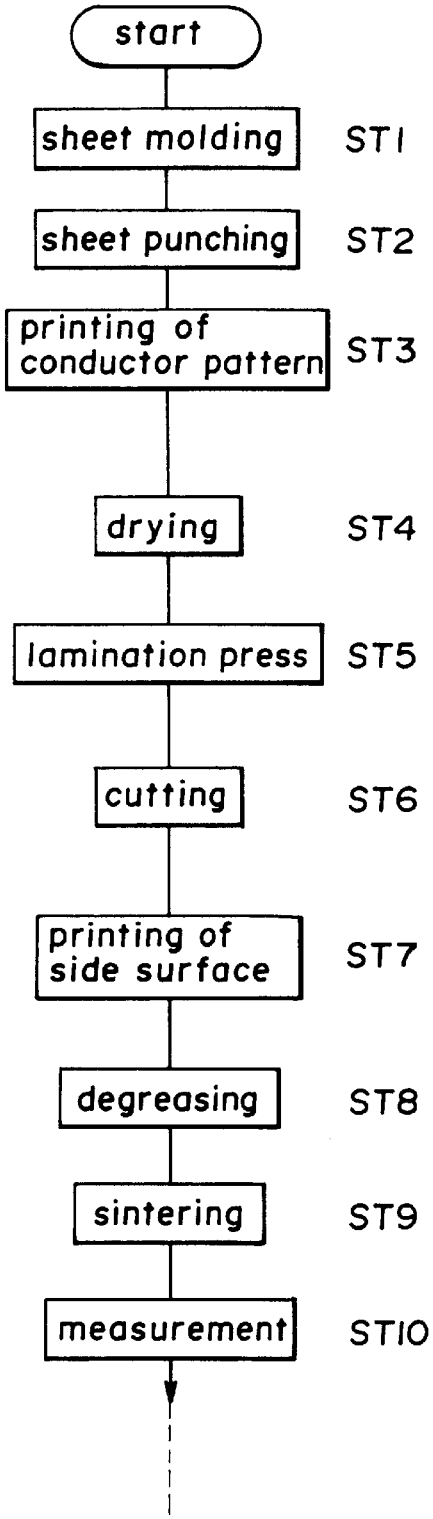
FIG. 4 is a diagram showing an embodiment of a production method of a laminate dielectric filer according to the present invention.

Next, an embodiment of the production method of the present invention will be explained. FIG. 4 is a diagram showing an example of the production process. As shown in the diagram, green sheets are shaped into a predetermined thickness by a doctor blade method, etc., (ST1). Next, the green sheets are punched into a predetermined shape and size (square, in this embodiment) so that printing, etc, can be applied (ST2).

A predetermined conductor pattern is printed on a predetermined sheet among the green sheets so formed and having the same shape and size (ST3). More specifically, silver paste is applied to the entire surface of the portion which will finally become a dielectric filter (that is, the entire surface of the inside with a predetermined margin from the peripheral edge) of one of the sides of the green sheets disposed at the lowermost and uppermost positions. A reference marker for cutting is simultaneously printed around the peripheral edge of the uppermost green sheet. Further, a plurality of belt-like conductor patterns are disposed in parallel with one another on the upper surface of the green sheet disposed at the intermediate position in the vertical direction.

Figure 5:
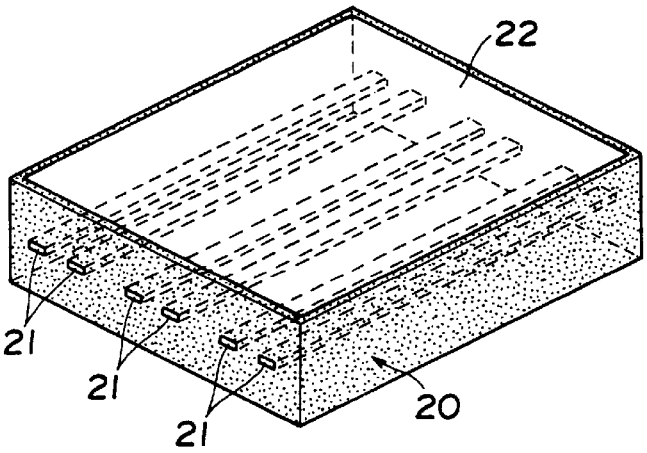
FIGS. 5 to 9 are views, each showing the state of an intermediate product during the production process according to the production method of the present invention.

The printed green sheets and the unprinted green sheets are dried (ST4) and are laminated in a predetermined sequence, and the green sheets adjacent to one another in the vertical direction are then bonded (ST5). In this way, a block body 20, which will serve as a laminate substrate, is formed as shown in FIG. 5, and a predetermined number of conductor patterns 21 are formed at the center of this block body 20. Further, a conductor paste 22 is applied throughout substantially the entire surface of the upper surface, and reference markers 23 for cutting are formed at predetermined positions of the peripheral edge of the upper surface.

Figure 6:
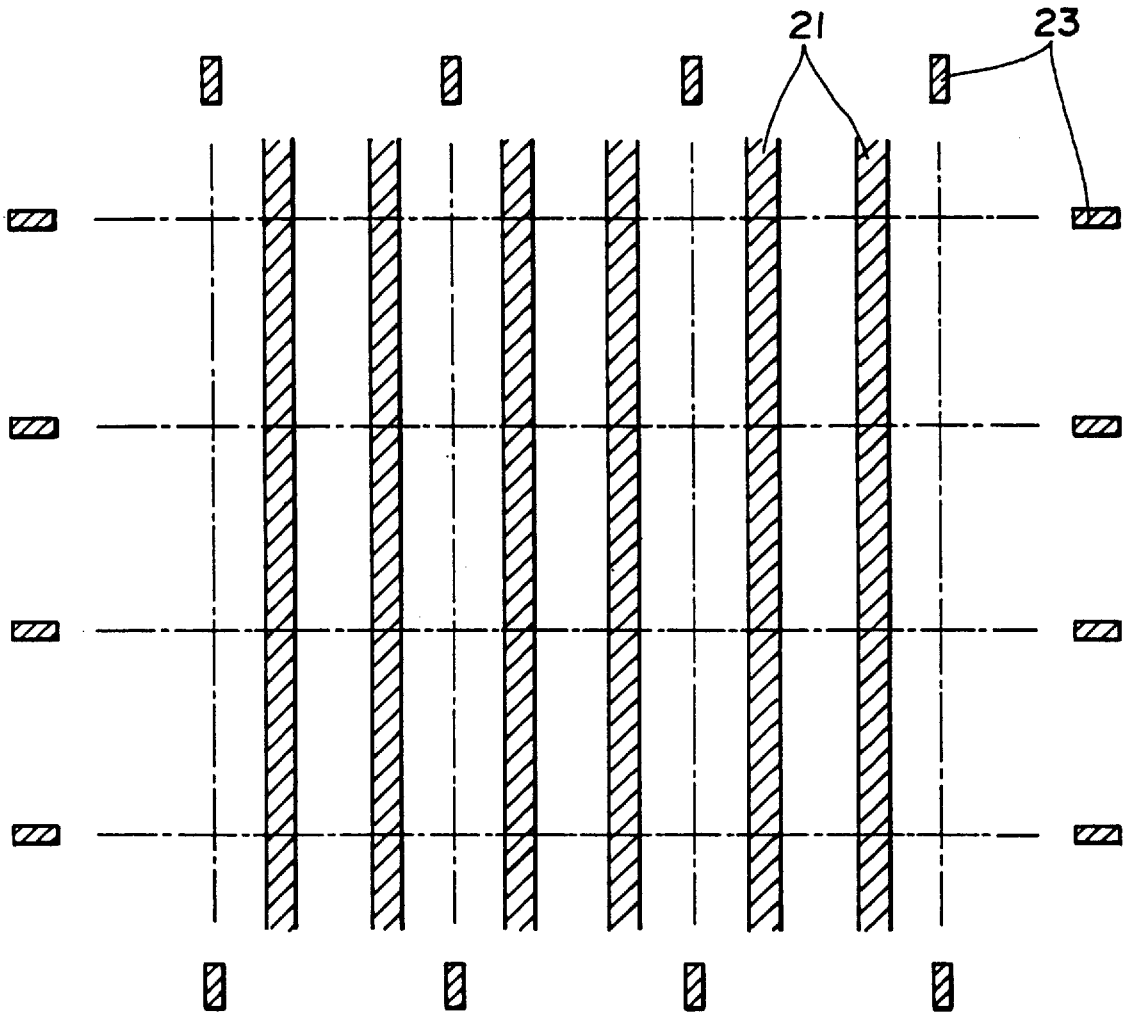

When the block body 20 described above is viewed through from above, lines connecting the pairs of the reference markers 23 for cutting, indicated by one-dot-chain line in FIG. 6, are in parallel with the internal conductor patterns 21 or cross them orthogonally. The reference markers 23 for cutting are formed in such a manner that the distance between the adjacent crossing lines corresponds to the ¼ wavelength of the resonance frequency of the dielectric filter to be produced. Since the block 20 shrinks when sintered in a later step, the distance is practically set to be somewhat greater than the ¼ wavelength. Further, since this embodiment is directed to produce the two-stage filter, the reference markers 23 for cutting 23 are formed in such a manner that the lines parallel to the conductor patterns 21 are positioned for every two conductor patterns 21. Each of the lines described above (the lines indicated by the one-dot-chain line) is an imaginary line drawn for convenience's sake and is not practically drawn.

Figure 7:
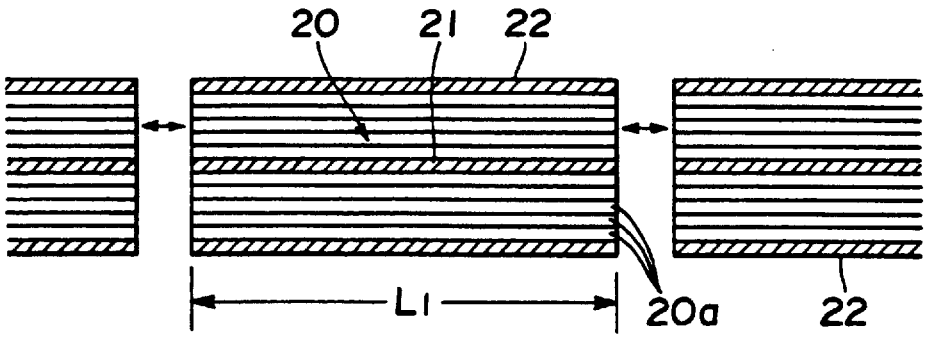

Next, the block body 20 is cut along the lines connecting the reference markers for cutting that forms the pair (ST6). Then, both ends of the conductor pattern 21 reach the cut section and the length L1 corresponds to the distance between the reference markers 23, that is, the ¼ wavelength, as shown in FIG. 7. This conductor pattern 21 becomes the belt-like resonance conductor in the final product.

Figure 8:
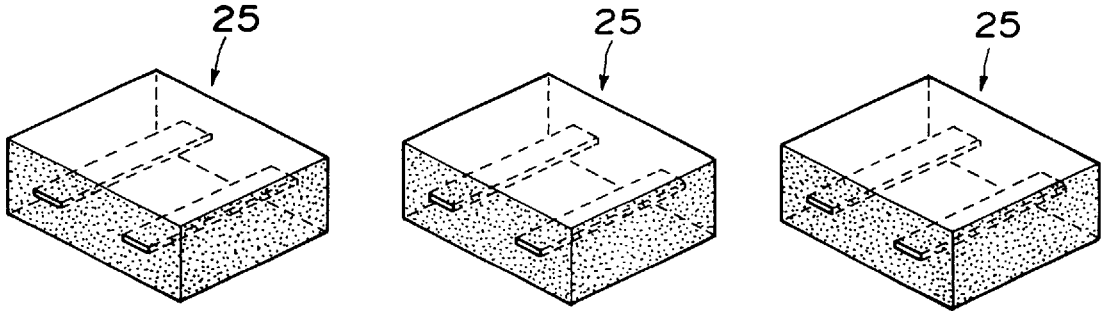
Figure 9:
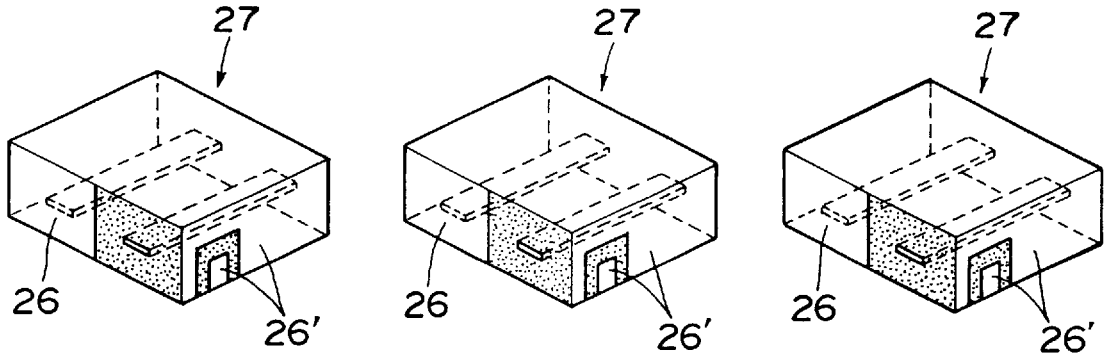

As can be clearly seen from the drawing, the block body (laminate substrate) 20 is formed by laminating a large number of green sheets 20*a*. The conductor paste 22 is applied to the upper and lower surfaces of these green sheets 20*a*. When the block body 20 is cut in the way described above, the individual laminate dielectric filters to be produced are separated as shown in FIG. 8. Under this state, the conductor paste covers the upper and lower surfaces of the laminate substrate (filter blank) 25 but the green sheets constituting the filter blank 25 are kept exposed on the four side surfaces. Moreover, this cutting is made by a cutter, etc., with high precision (with accuracy of the cut dimension of not greater than 50 $\mu$m) and a cut margin is not necessary. Accordingly, the green sheets can be effectively utilized.

Next, a predetermined pattern is printed with silver paste on the side surface of each filter blank 25 (ST7). Consequently, one of the conductor patterns exposed on the side surfaces is covered with the conductor paste 26, and the conductor paste 26' is also applied in the predetermined shape to the predetermined portion of the side surface on which the conductor pattern 21 is not exposed. Accordingly, a dielectric filter (before sintering) 27 with the pattern having substantially the same shape and size, which is a little greater in practice, as those of the dielectric filter shown in FIG. 1 can be formed.

After degreasing and sintering (ST8, ST9) in a customary manner, filter characteristics are measured (ST10). Fine adjustment (by removing a part of the predetermined pattern, for example) is further carried out when the desired characteristics are not obtained, and the final product is completed. Although this embodiment produces the filter having the construction shown in FIG. 1, other types such as shown in FIGS. 2 and 3 can be produced by changing the pattern at the side surface printing step at the step 7 (ST7).

The conductor pattern 21 (the portion which becomes the belt-like resonance electrodes 11, 12) formed into the dielectric sheet form having a great area at the step 3 (ST3) is obtained by only forming one elongated belt-like pattern, and there is no need for a complicated pattern which is cut or bent at predetermined positions. Accordingly, it can be produced easily.

A filter having desired frequency characteristics can be produced by appropriately changing the cut distance in the direction perpendicular to the conductor pattern 21 and moreover, in such a case, the mask for forming the conductor pattern 21 may be the same pattern. Further, the gaps between the reference markers 23 for cutting are all the same but they may be suitably different. Then, filters having different frequency characteristics can be produced simultaneously.

Figure 10:
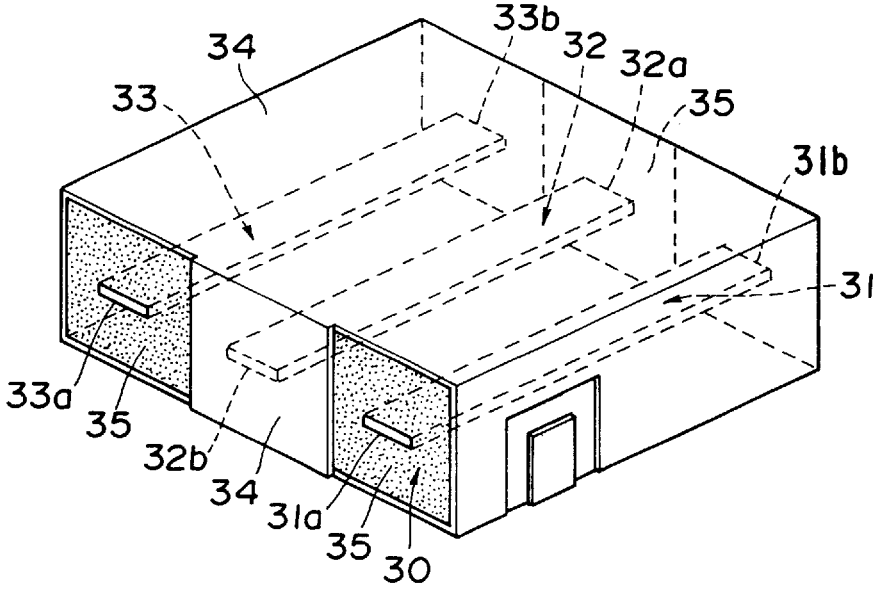
FIG. 10 is a perspective view of a laminate dielectric filter according to still another embodiment of the present invention.
Figure 11A:
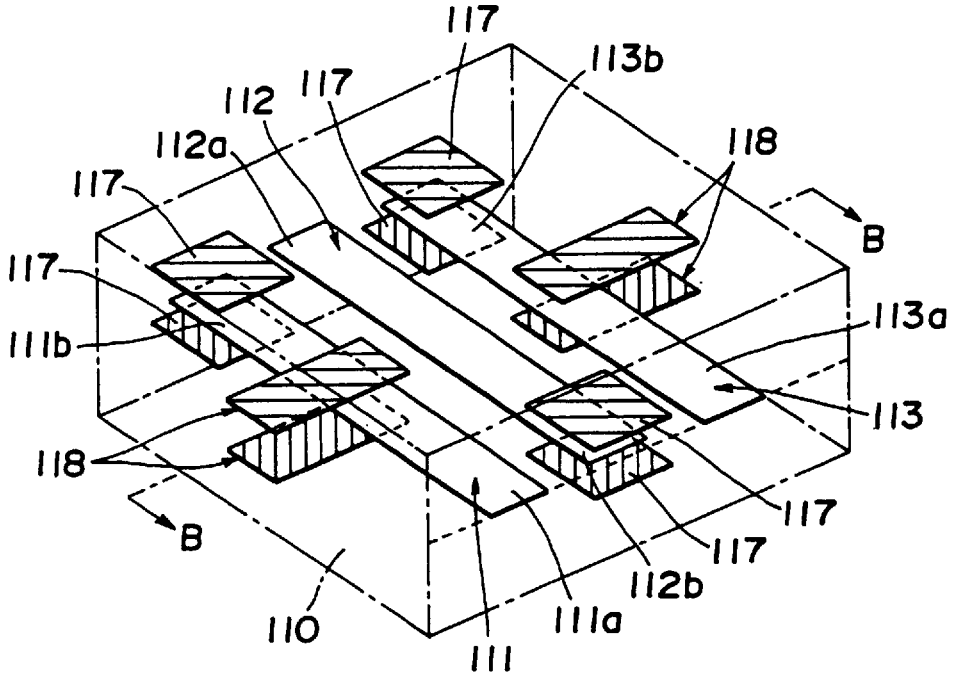
FIG. 11A is a perspective view of a laminate dielectric filter according to another embodiment of the present invention.
Figure 11B:
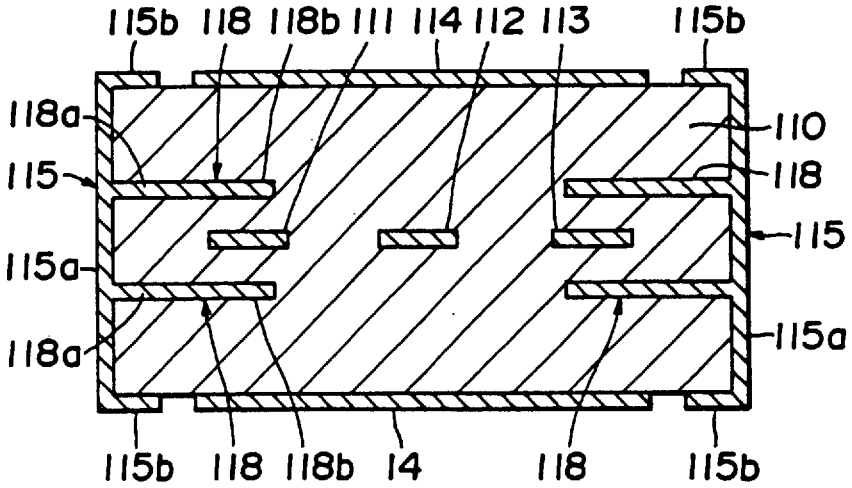
FIG. 11B is a sectional view taken along a line B—B of FIG. 11A.
Figure 12:
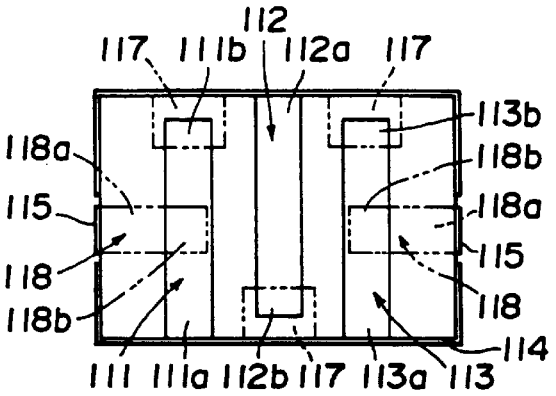
FIG. 12 is a plan view of the dielectric filter shown in FIG. 11A.
Figure 13:
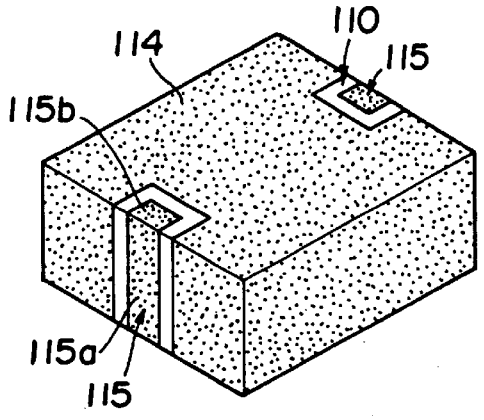
FIG. 13 is a perspective view showing the appearance of the dielectric filter shown in FIG. 11A.

Though the foregoing embodiments represent the two-stage filter, the present invention can also be applied to a three-stage filter (interdigital) as shown in FIG. 10, for example. In other words, three belt-like resonance electrodes 31, 32 and 33 are formed in parallel with one another by screen printing using the silver paste on a predetermined green sheet at the center of the direction of the height of the laminate substrate 30, and both ends of these belt-like resonance electrodes are extended to both side surfaces of the laminate substrate 30. The surface electrodes 34 are formed on the upper and lower surfaces of the laminate substrate 30. The earth electrode 34 is also formed at the central portion on one of the side surface of the laminate substrate 30 which is divided into three parts in the direction of disposition of the belt-like resonance electrodes 31 to 33 and to which the belt-like resonance electrodes 31 to 33 extend, and the rest are used at the ungrounded portion 35. On the opposite side surface, on the other hand, only the central portion divided into the three parts in used as the ungrounded portion 35.

According to the arrangement described above, one of the ends 31*a*, 33*a* of each belt-like resonance electrode 31, 33 is exposed on the ungrounded portion 35 formed on the same surface and functions as the open end. One of the ends of the belt-like resonance electrode 32 at the center is exposed, to the ungrounded portion 35 positioned on the opposite side surface and functions as the open end. On the other hand, the other end 31*b* to 33*b* of each belt-like resonance electrode 31 to 33 is connected to the earth electrode 34 formed on the respective predetermined side surface and functions as the short-circuit terminal. In this embodiment, too, since the length of each belt-like resonance electrode 31 to 33 is set to the ¼ wavelength, the length of the laminate dielectric filter is also the ¼ wavelength.

In the case of the three-stage type filter, the length of the belt-like resonance electrode 32 at the center is preferably a little smaller than the ¼ wavelength to obtain better characteristics. Accordingly, when higher quality is required, the length of the belt-like resonance electrode 32 may be reduced by cutting by a predetermined length the predetermined portion (existing portion of one end 32*a*) of the ungrounded portion 35 at which one end 32*a* of the belt-like resonance electrode exists, after the production of the filter. The combline may be of the four or more stage type, though it is not shown in the drawing.

As described above, the laminate dielectric filter and the production method thereof according to the present invention set the length of the laminate substrate constituting the laminate dielectric filter, that is, its outer dimension, to the length equal to that of the belt-like resonance electrodes built in the filter, and the filter can be made compact in size. To obtain desired frequency characteristics, the belt-like resonance electrode is required to have a predetermined length, but even when any printing error or cutting error exists, the lengths of the belt-like resonance electrodes can be set automatically by setting the length of the laminate substrate to the accurate value. For this reason, the desired characteristics can be obtained.

Though the filters of the prior art must use the belt-like pattern orthogonally crossing the belt-like resonance electrodes, the filter according to the present invention does not need such a belt-like pattern. Accordingly, the area of the internal electrodes can be minimized, the bonding strength between the dielectric sheets can be reinforced, the occurrence of wrinkles at the electrode portions or the sheet on which the electrodes are formed can be restricted, and the cost of production can be reduced.

In the production method according to the present invention, the relatively elongated belt-like pattern is formed on the dielectric sheet and is cut into a predetermined length. Therefore, filters having different frequency characteristics can be produced by merely changing the cutting length, and the mask for producing the conductor pattern on the dielectric sheet can be used in common. Further, even when a design change becomes necessary, compensation can be made by merely changing the cutting length as described above. Moreover, the existing production setup can be employed substantially as such by merely changing the mask, without an increase in the number of production process steps.

FIGS. 11(A) to 13 show the second embodiment of the present invention. As shown in these drawings, this embodiment represents the application of the present invention to the three-stage interdigital filter. First, a plurality of dielectric sheets (green sheets) is laminated and bonded to constitute a flat, rectangular parallelopipedic laminate substrate 110. Three belt-like resonator internal conductors 111, 112, 113 formed by screen printing using a conductor paste (silver paste) are disposed in parallel with one another on a predetermined green sheet at the center in the direction of height of this laminate substrate 110.

A surface earth electrode 114 is formed substantially over the entire surface of the laminate substrate 110, and two input/output electrodes 115 are formed locally. The input/output electrode 115 includes a belt-like portion 115*a* which penetrates vertically through the side surface of the laminate substrate 110 and small protuberances 115*b* having the same width as the belt-like portion 115*a* and continuously connected to both upper and lower end portions of the belt-like portion 115*a*. Each small protuberance 115*b* extends to a part of the top or bottom surface of the laminate substrate 110 and has a substantial U-shaped longitudinal section. An ungrounded portion is disposed to encompass the periphery of the input/output electrode 115 and to expose the laminate substrate 110 thereinside. Due to this ungrounded portion, the input/output electrode 115 is kept out of contact from the earth electrode 114.

The respective ends 111*a*, 112*a*, 113*a* of resonance internal conductor 111, 112, 113 are connected to the earth electrode 114 formed on the surface of the laminate substrate 110 and function as a short-circuit terminals. Moreover, since this embodiment is of the interdigital type, the short-circuit terminals 111*a* to 113*a* are positioned on mutually opposing surfaces. In other words, the short-circuit terminals 111*a*, 113*a* of the resonator internal conductors 111, 113 on both sides are positioned on the same side surface and the short-circuit terminal 112*a* of the resonator internal conductor 112 at the center is positioned on the opposite side surface.

The other ends 111*b*, 112*b* 113*b* of the resonator internal conductor 111, 112, 113 are positioned at the inside position spaced apart by a predetermined distance from the side surface of the laminate substrate 110 and constitute the open ends. A load capacitance pattern 117 is disposed inside the laminate substrate 110 spaced apart by a predetermined distance in the vertical direction (direction of thickness) while interposing the open ends 111*b* to 113*b*. More specifically, the pattern 117 is formed by screen printing using the silver paste at a predetermined position of the surface of the green sheet which is different from the green sheet on which the resonator internal conductors 111 to 113 are formed. As can be seen clearly from FIG. 12, the load capacitance pattern 117 is constituted in such a manner as to overlap the open ends 111*b* to 113*b* of the resonator internal conductors 111 to 113. One end of the load capacitance pattern 117 is connected to the earth electrode 114 to constitute the earth.

In this embodiment, the belt-like input/output terminal pattern 118 is formed on the bond surface different from the bond surface (the surface of the green sheet) on which the resonator internal conductors 111 to 113 are formed. One end 118*a* of this input/output terminal pattern 118 is connected to the input/output terminal 115. Further, the other end 118*b* of the input/output terminal pattern 118 overlaps the predetermined resonator internal conductors 111, 113, that is, the resonator internal conductors of the first stage positioned on both sides. As can be seen clearly from FIG. 11B, the input/output terminal patterns 118 overlapping one resonator internal conductor 111 (113) are opposed to each other and to interpose the resonator internal conductor 111 (113) between them. Their gaps with the resonator internal conductor are equal to each other.

In the arrangement described above, the resonator internal conductors 111 and 113 of the first stage and the input/output terminal patterns 118 establish capacitive coupling. Moreover, because the resonator internal conductors 111, 113 and the input/output terminal patterns 118 are so arranged as to overlap one another and both of them are disposed at a relatively short distance, the coupling quantity is great. In consequence, even when the electric field concentrates on the open end portion side 111*b* to 113*b* opposed the load capacitance pattern 117, this field concentration also occurs on the side of the input/output terminal pattern 118, and a sufficient coupling quantity can be obtained. Moreover, because the coupling quantity is great, the area of the input/output terminal pattern 118 can be reduced, so that the product can be made compact in size.

A desired coupling quantity can be obtained by changing the distances between the resonator internal conductors 111, 113 and the input/output terminal pattern 118 or by changing the overlapping area. Even when the shape or the position of disposition of the input/output terminal pattern 118 is changed so as to change the coupling quantity, no influences are imparted on the outer dimension.

In the embodiment described above, the distances of the pair of input/output terminal patterns 118, so disposed as to face the upper and lower resonator internal conductors 111, 113 from the conductors 111, 113 are set to equal with each other, but they may be different, too. When the vertical distances are so changed, fine adjustment of the coupling quantity can be effected. Further, the position of disposition of the load capacitance pattern 117 in the direction of thickness (bond surface) and the position of disposition of the input/output pattern 118 in the direction of thickness (bond surface) may be the same or different, and they are disposed at respective positions in order to obtain predetermined characteristics.

In this embodiment, the input/output terminal pattern 118 is disposed at the intermediate position between the resonator internal conductors 111 and 113 and moreover, the input/output electrode 115 is shaped into a substantial U-shape. Accordingly, they can be formed substantially symmetrically as a whole, so that shrinkage at the time of drying and sintering develops uniformly as a whole and the filter can be produced with good balance. Moreover, since the filter in this embodiment is symmetric in the vertical direction, too, the filter can be mounted on any of its surfaces when it is surface-mounted to a practical circuit board, and assembly becomes easier.

Figure 14:
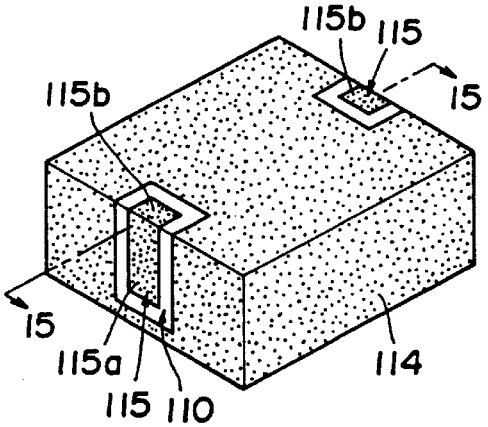
FIG. 14 is a perspective view showing the appearance of a laminate dielectric filter according to still another embodiment.
Figure 15:
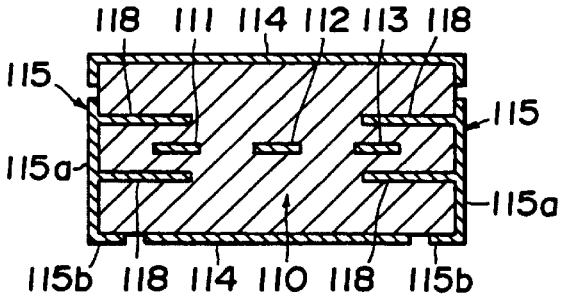
FIG. 15 is a sectional view taken along a line 15—15 of FIG. 14.

FIGS. 14 and 15 show a modification of the second embodiment described above. In this modification, the shape of the input/output electrode 115 to be formed on the surface of the laminate substrate 110 is changed. In other words, a belt-like portion 115*a* is disposed at the lower portion of the side surface of the laminate substrate and a small protuberance 115*b* having the same width as the belt-like portion 115*a* is continuously connected to the lower end (reaching the lower end of the side surface) of the belt-like portion 115*a* at a predetermined position on the bottom surface of the laminate substrate 110. In this way, a substantial L-shaped longitudinal section is formed as a whole. The input/output electrode 115 having this substantially L-shaped section, too, is kept out of contact from the earth electrode-114 formed on the surface of the laminate substrate 110. Incidentally, the top and the bottom are turned upside down for convenience's sake in FIG. 14, and the term "bottom surface" in this specification means the surface which is mounted practically to the circuit board.

In the construction described above, the earth electrode 114 exists at the upper portion of the side surface of the laminate substrate 110, on which the input/output electrode 115 is formed, along the side and moreover, the earth electrode 114 exists on the top surface of the laminate substrate 110 throughout the entire surface. Accordingly, the shield effect becomes higher and the exposed portion of the input/output electrode 115 after mounting can be remarkably reduced, so that short-circuiting with other components can be reduced to minimum. The rest of the construction and the function and effects are the same as those of the second embodiment described above.

Figure 16:
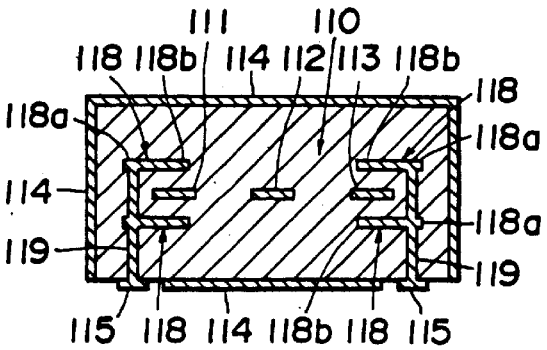
FIG. 16 is a sectional view showing still another embodiment of the present invention.

FIG. 16 shows still another modification of the laminate dielectric filter according to the second embodiment. In this embodiment, the input/output terminal patterns 118 are disposed at predetermined positions inside the laminate substrate 110 in such a manner as to face each other and to interpose the resonator internal conductors 111, 113 of the initial stage between them. One end 118*a* of each input/output terminal pattern 118 does not reach the side surface of the laminate substrate 110 but is kept within a predetermined distance. The other end 118*b* of each input/output terminal pattern 118 overlaps the resonator internal conductor 111, 113.

On the other hand, the input/output electrode 115 is formed at a predetermined position of the bottom surface of the laminate substrate 110 (below the input/output pattern 118). The input/output electrode 115 is connected to the input/output terminal pattern 118 through a via-hole (which is formed by filling a through-hole with a conductor material such as the silver paste) 119 formed as a conductive passage inside the laminate substrate 110. Incidentally, the conductive passage is not necessarily limited to the via-hole; various other shapes such as the through-hole can be employed, as well.

In the construction described above, the earth electrode 114 exists throughout the entire surface of the side and top surfaces of the laminate substrate 110. Accordingly, the shield effect can be further improved, and short-circuiting with other components can be reduced by extremely reducing the exposed portion of the input/output electrode 115 after mounting.

Since the rest of the construction and the function and effects are the same as those of the foregoing embodiments, a further explanation will be omitted.

Figure 17:
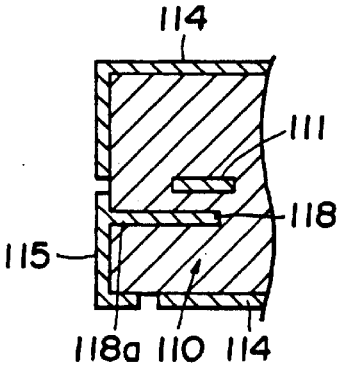
FIG. 17 is a sectional view showing the principal portions in still another embodiment of the invention.

FIG. 17 shows still another modification, which is based on the embodiments shown in FIGS. 14 and 15, and the input/output pattern 118 formed inside the laminate substrate 110 is different. In other words, in the embodiments shown in FIGS. 14 and 15, two input/output terminal patterns are formed at the upper and lower positions in such a manner as to interpose one resonator internal conductor between them but in the embodiment shown in FIG. 17, only one input/output terminal pattern 118 is disposed. In the embodiment shown in this drawing, the input/output terminal pattern 118 is disposed below the resonator internal conductor 111 with a predetermined distance therefrom, and one end 118*a* is connected to the input/output electrode 115 having an L-shaped section. The opposite side has the same construction, though it is not shown in the drawing.

In the embodiment shown in the drawing, the input/output terminal pattern 118 is shown disposed below the resonator internal conductor 111 but it may be disposed above the conductor 111. However, the input/output terminal pattern 118 is preferably disposed below the resonator internal conductor 111 because the exposure area on the side surface of the input/output electrode 115 can be reduced by so doing as shown in the drawing. The arrangement described above wherein only one input/output terminal pattern is disposed can be applied also to the embodiment shown in FIG. 11A, the embodiment shown in FIG. 16 and the following modified embodiments.

Figure 18:
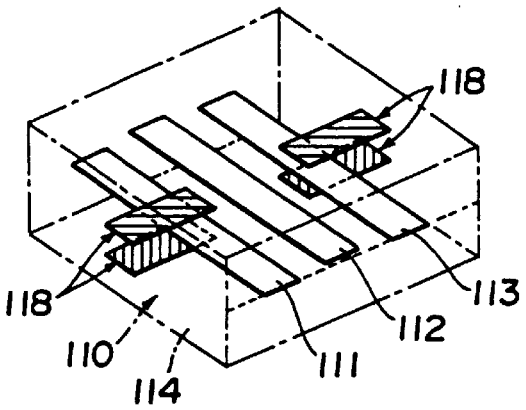
FIG. 18 is a perspective view of a laminate dielectric filter according to still another embodiment of the invention.

FIG. 18 shows still another modification of the laminate dielectric filter. In each of the foregoing embodiments shown in FIGS. 11A to 17, the load capacitance pattern 117 is disposed at the open terminal 11*b* to 113*b* of the resonator internal conductor 111 to 113 but this embodiment of FIG. 18 represents a laminate dielectric filter comprising an ordinary structure not having the load capacitance pattern 117. Accordingly, the length of the resonator internal conductor 111 to 113 is set to the length corresponding to the ¼ wavelength of the resonance frequency. The input/output terminal patterns 118 are disposed above and below the resonator internal conductors 111, 113 with predetermined distance between them, respectively. Each input/output terminal pattern 118 is connected to the input/output electrode (not shown) disposed on the surface of the laminate substrate 110 by using various constructions of the foregoing embodiments. The rest of construction, and the function and effects are the same as those of the foregoing embodiments.

Figure 19:
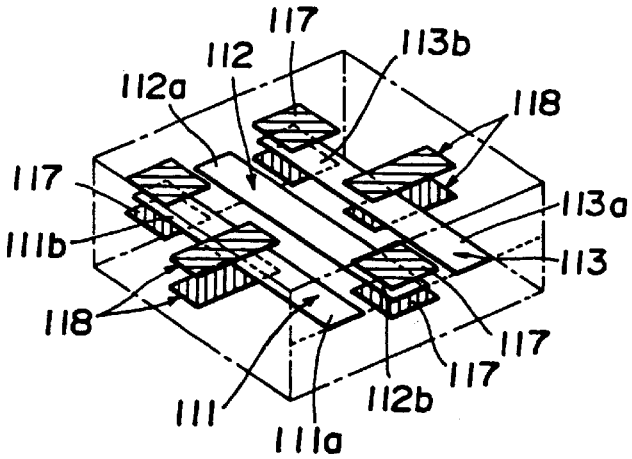
FIG. 19 is a perspective view of a laminate dielectric filter according to still another embodiment of the invention.
Figure 20:
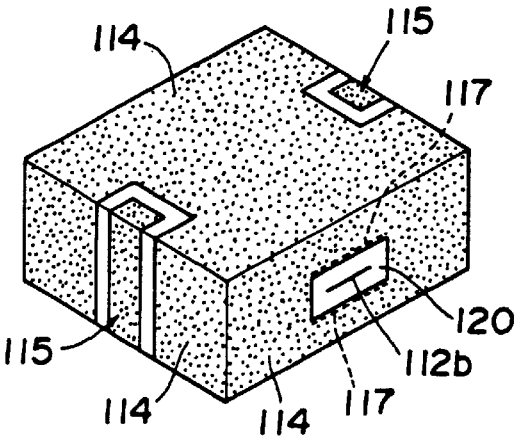
FIG. 20 is a perspective view showing the appearance of the laminate dielectric filter shown in FIG. 19.

FIGS. 19 and 20 show a laminate dielectric filter according to still another embodiment. This embodiment is based on the embodiment shown in FIG. 11A, etc, and is different in the arrangement of the resonator internal conductors 111 to 113 formed inside the laminate substrate 110. In other words, three belt-like resonance electrodes 111 to 113 are formed in parallel with one another by screen printing using the silver paste on a predetermined green sheet at the central position in the direction of height of the laminate substrate 110. Both ends of each conductor 111 to 113 reach both side surfaces of the laminate substrate 110.

The surface earth electrodes 114 are formed on the top and bottom surfaces of the laminate substrate 110. At this time, a region of the side surface of the laminate substrate 110, to which the open terminal of each resonance electrode 111 to 113 extends, is used as the ungrounded region 120. In FIG. 20, the open terminal 112*b* of the resonator internal conductor 112 at the center is exposed to the outside through the ungrounded portion 120 and is kept out of contact with the surrounding earth electrode. The load capacitance patterns 117 exist above and below this open terminal 112*b*, and are connected to the earth electrodes 114 positioned above and below the ungrounded portion 120.

Although not shown in the drawing, the periphery of the open terminal of the resonator internal conductors 111, 113 at the initial stage is used as the ungrounded region on the opposite side surface. On the other hand, the short-circuit terminal of each resonator internal conductor 111 to 113 is connected to the earth electrode 114 formed on the side surface of the laminate substrate 110 in the same way as in each of the foregoing embodiments.

According to the arrangement described above, the length of the laminate substrate 110 becomes equal to the length of each resonator internal conductor 111 to 113, and a predetermined margin is not necessary on the side of the open terminal as it is required in each of the foregoing embodiment, so that the reduction of the size of the filter can be accomplished.

In the case of the three-stage filter, the resonator internal conductor 112 at the center is preferably a little shorter than the resonator internal conductors 111, 113 on both sides because a better characteristic can be obtained. Accordingly, where higher precision quality is required, the length of the resonator internal conductor 112 may be reduced by cutting off a predetermined portion (the existing portion of the open terminal 112*b*) of the ungrounded portion 120, on which the open terminal 112*b* of the resonator internal electrode 112 is exposed, after the production of the filter. The construction represented by this embodiment, that is, the construction wherein both ends of each of the resonator internal conductors is extended to the side surfaces of the laminate substrate, can be applied to each of the foregoing embodiments. Though each of the foregoing embodiments deals with the three-stage interdigital type laminate dielectric filter, the present invention is not particularly limited to such a filter but can be also applied to the combline type filter.

Figure 21A:
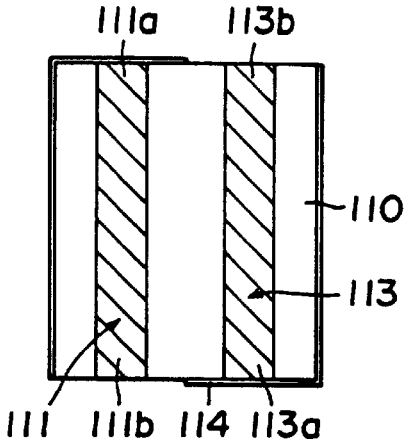
FIGS. 21A, 21B and 21C are views each showing the laminate dielectric filter used for experiments for evidencing the effects of the present invention.
Figure 21B:
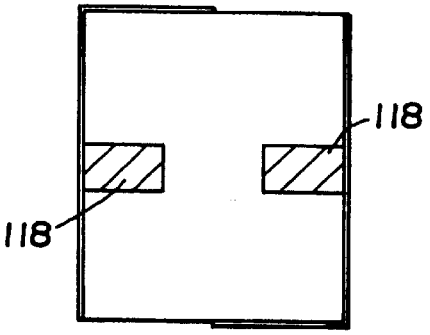
Figure 21C:
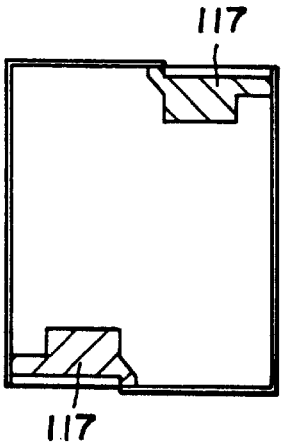
Figure 22A:
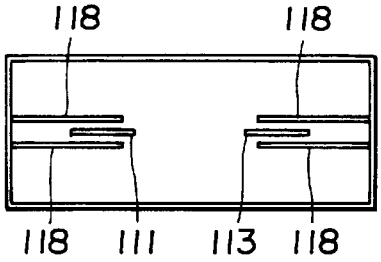
FIGS. 22A and 22B show laminate dielectric filters used for evidencing the effects of the present invention.
Figure 22B:
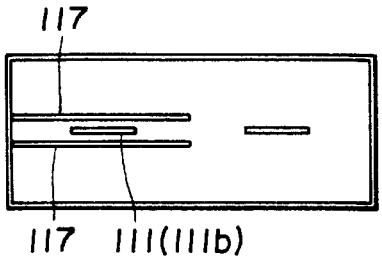

Next, the following experiment was carried out in order to evidence the effects of the present invention, and the results will be explained. First, the laminate dielectric filter used for the experiment was a two-stage interdigital type as shown in FIG. 21A, wherein both ends of each resonator internal conductor 111, 113 reach both ends of the laminate substrate 110 in the same way as in the embodiment shown in FIGS. 19 and 20. In other words, the short-circuit terminals 111*a*, 113*a* were connected to the earth electrodes 114, and the earth electrode was not formed on the side of the open terminals 111*b*, 113*b*. Belt-like input/output terminal patterns 118 are formed on a predetermined green sheet in such a manner as to overlap the resonator internal conductors 111, 113 as shown in FIG. 21B. Further, the shape such as shown in FIG. 21C was used as the load capacitance pattern 117 for covering the side of the open terminals 111*b*, 113*b*. These patterns were then laminated suitably and as a result, the input/output terminal pattern 118 and the load capacitance pattern 117 were so disposed as to oppose each other in the vertical direction while interposing the resonator internal conductors 111, 113 as shown in FIGS. 22A and 22A. As is obvious from the drawing, the load capacitance pattern 117 was closer to the resonator internal conductors in this embodiment.

Figure 23:
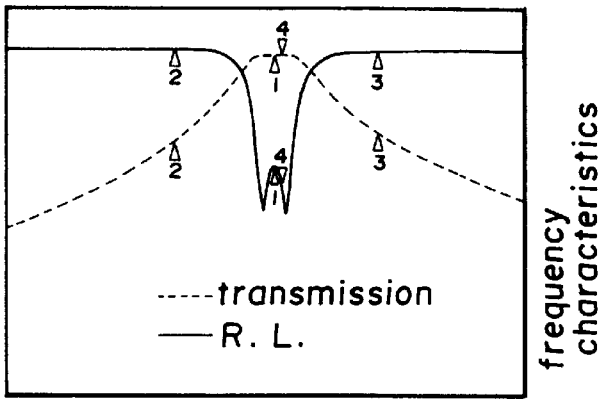
FIG. 23 is a graph showing the frequency characteristics of the filters shown in FIGS. 21A and 22A.

When the frequency characteristics (return loss to the frequency and transmission) were determined in such a construction, the result shown in FIG. 23 could be obtained and the return loss was 15.1 dB. The bandpass width was 46.8 MHz, and a smooth inclination curve could be observed in the bandpass region.

Figure 24:
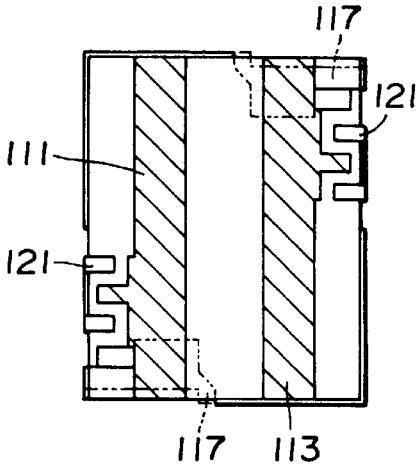
FIGS. 24 and 25 show a laminate dielectric filter (Comparative Example) use for experiments for evidencing the effects of the present invention and a graph showing its frequency characteristic, respectively.

As a comparative example, on the other hand, a laminate dielectric filter was produced by using resonator internal conductors 111, 113, which were equipped with protuberances for coupling with input/output terminal patterns, having substantially the same shape as a load capacitance pattern 117 and disposing input/output terminal patterns 121 having a predetermined shape and size on the same line as the resonator internal conductors 111, 113 as shown in FIG. 24. The size and the shape of each portion were the same as those of the filters shown in FIGS. 21A, 21B, 22A and 22B.

Figure 25:
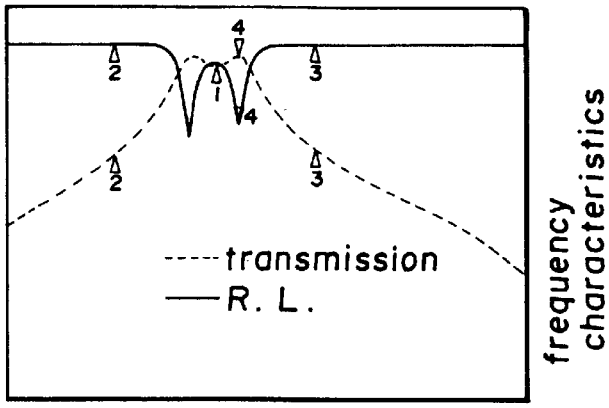

When the frequency characteristic (return loss to the frequency and transmission) were obtained for the construction described above, the results shown in FIG. 25 were obtained, and the return loss was 2.3 dB. In other words, although the conductors were closer to the open terminal side (load capacitance pattern) so as to improve coupling in this comparative example, coupling was inferior, and the return loss was greater than that of the filter of the present invention. The bandpass width was 52.9 MHz and became broader. It become a two-peak type in which the curve dropped once, at the intermediate portion in the bandpass zone, and, in this way, too, the characteristics were inferior to those of the present filter.

As described above, in the laminate dielectric filters of the embodiment shown in FIGS. 11 to 25, the input/output terminal patterns are so disposed as to overlap the resonator internal conductors of the initial stage with a predetermined distance in the direction of thickness. Accordingly, coupling between the resonator internal conductors and the input/output terminal patterns, that is, the input/output electrodes, becomes greater when the overlapping area is greater and, also, becomes greater when the distance between the input/output terminal pattern and the resonator internal conductor is smaller. Accordingly, desired first stage coupling can be obtained even when the input/output terminal pattern is made small, and the filter characteristics (frequency characteristics) become stable.

Moreover, because the input/output terminal patterns and the resonator internal conductors are so disposed as to overlap one another in the vertical direction, a great region (i.e., the region in which the input/output patterns are disposed in the prior art filters) outside the resonator internal conductor becomes unnecessary with the reduction of the size of the input/output terminal patterns, so that the outer dimension of the product can be reduced.

The coupling quantity of initial stage coupling can be easily changed by changing the overlapping area or the distance between the input/output terminal patterns and the resonator internal conductors and, moreover, such a change can be made by adjusting the positions of disposition of the internal patterns and their condition, and does not affect the outer dimension.

Further, the input/output terminal patterns and the resonator internal conductors can be disposed on the separate dielectric sheets, and the input/output terminal patterns, too, can be made small. For this reason, since the direct bonding area of the dielectric sheets which are so arranged as to interpose such resonator internal conductors and input/output terminal patterns between them becomes great, the bonding strength increases and, in consequence, delamination hardly occurs on the bond surface.

Even when the load capacitance pattern is disposed at the open terminal of the resonance internal conductor, the field concentrates not only on the side of the load capacitance pattern but also in the vicinity of the input/output terminal pattern. Accordingly, sufficient coupling can be obtained. In other words, when the load capacitance pattern is provided, the length of the resonator internal conductor can be set to not greater than the ¼ wavelength. Moreover, since sufficient coupling can be obtained as described above, further miniaturization of the filter can be promoted. Since initial stage coupling between the input/output terminal pattern and the conductor internal conductor can be improved and matching can be established more easily as described above, limitations to the bandwidth of the filter can be reduced.

When two input/output terminal patterns are so disposed as to face each other while interposing one resonator internal conductor between them or when the input/output electrodes are formed in such a manner as to vertically penetrate through the side surfaces of the laminate substrate and to partly bridge the top and bottom surfaces continuing the side surfaces, the filter can be constituted symmetrically as a whole. Accordingly, shrinkage at the time of drying and backing proceeds uniformly as a whole, and the filter can be produced with good balance. Moreover, since the filter is symmetric in the vertical direction, it may be mounted on any of its surfaces when surface mounted to the practical circuit board, and assembly becomes easier. Furthermore, when two input/output terminal patterns are so disposed as to oppose each other, the coupling state can be further improved in addition to the advances in the production process described above.

When the input/output electrodes are formed at the lower portion of the side surfaces of the laminate substrate and at a part of the bottom surface continuing the side surfaces, or when the input/output electrodes are formed at the predetermined positions of the bottom surface of the laminate substrate and are connected to the input/output terminal patterns through the conductive passage formed inside the laminate substrate, the earth electrodes can be disposed on the entire top surface of the laminate substrate and at a part, or the whole surface, of the side surfaces, and the shield effect becomes higher. Since the exposed portions of the input/output electrodes 115 after mounting can be reduced to minimum, short-circuiting with other components can be reduced to minimum, too. Accordingly, the characteristics of the laminate dielectric filter can be stabilized and improved.

We claim:

1. A laminate dielectric filter comprising:

a laminate substrate formed by a plurality of laminated dielectric sheets;

a plurality of parallel and coplanar resonator internal conductors formed inside of said laminate substrate;

an earth pattern formed on an outer periphery of said laminate substrate;

input/output electrodes formed on the outer periphery of said laminate substrate under a non-connection state with said earth pattern; and two input/output terminal patterns extending into said laminate substrate from each of said input/output electrodes, disposed in such a manner as to extend over opposite sides of one of said resonator internal conductors, and opposing each other with said one of said resonator internal conductors interposed between facing surfaces of said two input/output terminal patterns.

2. A laminate dielectric filter according to claim 1, wherein each of said input/output electrodes includes a portion which is formed at a predetermined position of a bottom surface of said laminate substrate, and connection between said input/output electrodes and said input/output terminal patterns is established through conductive passages formed inside said laminate substrate.

3. A laminate dielectric filter according to claim 1, wherein each of said input/output electrodes includes a portion which vertically extends over a side surface of said laminate substrate and bridges a part of top and bottom surfaces continuing said side surface.

4. A laminate dielectric filter according to claim 1, wherein each of said input/output electrodes bridges a lower portion of a side surface of said laminate substrate and a part of a bottom surface continuing the side surface.

5. A laminate dielectric filter according to claim 1, further comprising load capacitance patterns defined inside said laminate substrate to overlap a portion of an open terminal of at least one of said resonator internal conductors and at a position spaced apart therefrom by a predetermined distance in a direction of thickness.

6. A laminate dielectric filter according to claim 5, wherein each of said input/output electrodes includes a portion which vertically extends over a side surface of said laminate substrate and bridges a part of top and bottom surfaces continuing said side surface.

7. A laminate dielectric filter according to claim 5, wherein each of said input/output electrodes bridges a lower portion of a side surface of said laminate substrate and a part of a bottom surface continuing the side surface.

* * * * *